US007611358B2

(12) United States Patent
Cox et al.

(10) Patent No.: US 7,611,358 B2
(45) **Date of Patent: *Nov. 3, 2009**

(54) METHOD OF COUPLING CIRCUIT BOARD CONNECTORS

(75) Inventors: Ned Cox, Gray, TN (US); Sorin Homescu, Knoxville, TN (US); James Allen Knoop, Flag Pond, TN (US); Michael Ross Massie, Bristol, TN (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/851,928

(22) Filed: Sep. 7, 2007

(65) Prior Publication Data

US 2008/0124951 A1 May 29, 2008

Related U.S. Application Data

(60) Provisional application No. 60/843,149, filed on Sep. 8, 2006.

(51) Int. Cl.
*H01R 12/00* (2006.01)

(52) U.S. Cl. ..... 439/65; 439/607.58

(58) Field of Classification Search ..... 439/65, 439/607.01, 607.04, 607.23, 607.25, 607.53, 439/607.58, 660

See application file for complete search history.

(56) References Cited

U.S. PATENT DOCUMENTS

| | | | | |
|---|---|---|---|---|
| 3,993,935 | A | 11/1976 | Phillips | |
| 4,480,885 | A * | 11/1984 | Coppelman | 439/159 |
| 4,697,864 | A | 10/1987 | Hayes | |
| 6,050,853 | A | 4/2000 | Ando | |
| 6,572,409 | B2 * | 6/2003 | Nitta et al. | 439/608 |
| 6,733,301 | B2 | 5/2004 | Brown | |
| 6,769,735 | B1 * | 8/2004 | Winkler | 297/112 |
| 6,808,419 | B1 * | 10/2004 | Korsunsky et al. | 439/607.23 |
| 6,866,544 | B1 | 3/2005 | Casey | |
| 7,160,151 | B1 * | 1/2007 | Rigby et al. | 439/607.58 |
| 7,455,528 | B2 * | 11/2008 | Cox et al. | 439/65 |
| 2004/0240191 | A1 | 12/2004 | Arnold | |
| 2005/0009382 | A1 | 1/2005 | Burmeister | |
| 2006/0264104 | A1 | 11/2006 | Olson | |

FOREIGN PATENT DOCUMENTS

| | | |
|---|---|---|
| EP | 745279 | 8/1995 |

* cited by examiner

*Primary Examiner*—Edwin A. Leon
*Assistant Examiner*—Vanessa Girardi
(74) *Attorney, Agent, or Firm*—Jose R. de la Rosa

(57) ABSTRACT

Certain exemplary embodiments comprise a slide connector that can be adapted to electrically couple a first circuit board to a second circuit board. The first circuit board can comprise a first receptacle. The second circuit board can comprise a second receptacle. The slide connector can be adapted to be slideably releaseably coupled to each of the first receptacle and the second receptacle.

19 Claims, 11 Drawing Sheets

6000

8000

METHOD OF COUPLING CIRCUIT BOARD CONNECTORS

CROSS-REFERENCES TO RELATED APPLICATIONS

This application claims priority to, and incorporates by reference herein in its entirety, pending U.S. Provisional Patent Application 60/843,149, filed 8 Sep. 2006.

BACKGROUND

Control systems can be used for monitoring parameters and/or controlling devices. Within control systems, one or more sensors can be communicatively coupled to a programmable logic controller (PLC) via one or more input/output (I/O) modules. Via an I/O module, the PLC can control one or more devices, such as a rheostat, switch, sequencer, stepper motor controller, servo controller, actuator controller, stepper drive, servo drive, stepper motor, servomotor, linear motor, motor, ball screw, servo valve, hydraulic actuator, and/or pneumatic valve, etc.

SUMMARY

Certain exemplary embodiments can comprise a slide connector that can be adapted to electrically couple a first circuit board to a second circuit board. The first circuit board can comprise a first receptacle. The second circuit board can comprise a second receptacle. The slide connector can be adapted to be slideably releaseably coupled to each of the first receptacle and the second receptacle.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
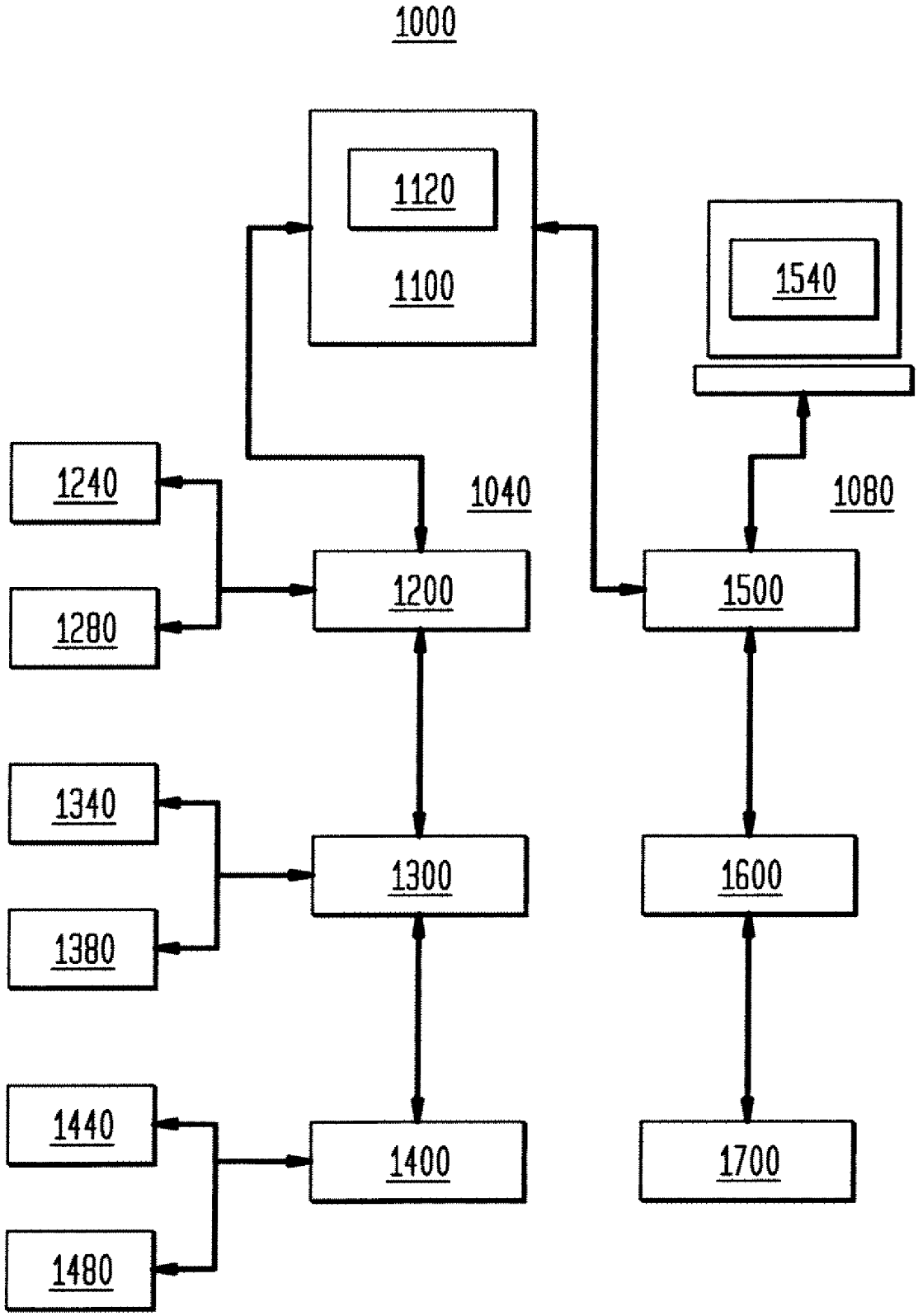
FIG. 1 is a block diagram of an exemplary embodiment of a system 1000.

Electrically coupling the PLC to one or more modules and/or providing electromagnetic shielding for signals therebetween can be important to reliable PLC system operations. Thus, certain exemplary embodiments provide a slide connector that can be adapted to electrically couple a first circuit board to a second circuit board, either and/or both of which can be a PLC circuit board and/or a module circuit board. The first circuit board can comprise a first receptacle. The second circuit board can comprise a second receptacle. The slide connector can be adapted to be slideably releaseably coupled to each of the first receptacle and the second receptacle.

In certain exemplary embodiments, a micro programmable logic controller (PLC) configuration can comprise a central processing unit (CPU) and one or more expansion modules. An expansion module can be adapted to provide an end user with control functions that might or might not be comprised by the CPU. In certain exemplary embodiments, an electrical interconnecting system can be adapted for a transfer of information (data) to and from the CPU and/or communicatively coupled expansion modules. PLC systems can be installed in noisy electrical environments that might have a potential to corrupt data exchanged between the CPU and expansion modules. Certain exemplary embodiments can be adapted to provide relatively reliable, low cost, and/or robust bus communications.

Certain exemplary embodiments can provide a relatively low cost interconnecting system that provides for relatively low electromagnetic interference (EMI) effects. In certain exemplary embodiments, the interconnecting system can be adapted to reduce a probability that electromagnetic interferences (EMI) might enter the system and can be adapted to prevent the system from radiating EMI. In certain exemplary embodiments, a relatively low cost and relatively highly robust interconnect system can be provided. A relatively robust interconnecting system can comprise a shield that substantially encompasses and/or surrounds electrical conductors and/or connection points for electrical conductors. Relative robustness might be achieved via a shield, which can be adapted to provide a relatively low impedance connection between two grounds as well as adapted to provide a shield effect from electromagnetic fields that might be present.

Certain exemplary embodiments can provide a relatively low cost interconnecting system that can be adapted to provide a relatively low impedance ground connection between two systems without the use of a substantially encompassing shield apparatus. In certain exemplary embodiments, a partial or semi-shield can be achieved thus creating a relatively low impedance ground connection and providing a shield effect from electromagnetic fields. Certain exemplary embodiments might not fully encompass the conductors with a shield. In certain exemplary embodiments, the shield can substantially encompass three sides and when two systems are connected the ground planes of respective printed wiring boards can act as a shield for an un-shielded side of the connector. Certain exemplary embodiments can provide:

- a second receptacle, which can comprise:
  - sockets adapted to receive pins; and/or
  - a conductive shroud, which can be fixed on three sides of the receptacle;
- a first receptacle that can be identical to the second receptacle;
- a slide connector, which can comprise an insulating substrate, conductive pins for connecting (sliding into) to corresponding receptacle sockets, and an electrically conductive liner adapted to be electrically coupled to an electrically conductive shield of the receiving and first receptacles.

Certain exemplary embodiments can:

- comprise a relatively small interconnecting system (such as less than approximately 30 millimeters);
- be relatively robust;
- make use of pins for conductors rather that wires, which can improve current flow;
- be surface mount for relative ease of manufacturing;

comprise a relatively low impedance ground connection, which can improve electrical noise immunity and/or radio frequency (RF) emissions;

comprise an electrically conductive shield that substantially encompasses three sides and/or approximately 75 percent of signal carrying conductors;

be comprised by a system wherein a fourth side and/or approximately 25% of the signal carrying conductors can be effectively shielded by the two printed wiring boards. In certain exemplary embodiments, the effective shielding can be achieved when the slide connector is used to connect two modules together;

in certain exemplary embodiments, insulating material might not be utilized between the shield and conductor. In certain exemplary embodiments, insulating material might be an air gap; and/or adapted to, in relative terms, reduce EMI by substantially surrounding the electrical conductors with a conductive material, which can be electrically coupled to ground on three sides.

In certain exemplary embodiments, an electrically conductive liner, which can comprise a metallic material, can be provided at a location wherein metallic extensions meet a wrap-around electrically conductive and/or metallic bracket provided on receptacles for grounding. The metallic material can be a paint, solid metal, and/or alloy, etc.

Receptacles can be mounted to adjacent printed circuit boards (PCBs) with the Slide connector adapted to electrically couple the adjacent printed circuit boards.

Receptacle specifications can comprise:

the receptacle can be mounted such that the signal pins (i.e., metallic extensions) face away from a PCB edge and at least one face of an electrically conductive shield, which can be coupled to ground, faces the edge of the PCB (which can improve electrostatic discharge immunity);

a relatively robust electrical coupling between the electrically conductive shield of the receptacle and the PCB can be made. In certain exemplary embodiments, one or more surface mount technology (SMT) pins might be utilized to electrically couple the ground shield to the PCB.

the receptacle's ground shield can be adapted to connect to the shield in the Slide connector to the PCB. The electrically conductive liner can be adapted to wrap the receptacle:

for relatively good contact with the slide connector and for electromagnetic compatibility (EMC) shielding, the electrically conductive liner can wrap:

over the top;

over left and right sides; and/or around the front (nearest the edge of PCB) so that electrostatic discharge (ESD) can be diverted to the electrically conductive liner.

Slide connector specifications can comprise:

In certain exemplary embodiments, one or more points of contact might be utilized between the electrically conductive shield of the receptacle and the electrically conductive liner of the slide connector, such as:

contacts on the right side of the receptacle;

contacts on the left side of the receptacle; and/or a contact on the top of the receptacle, etc.

when the slide connector is installed between two receptacles, the slide connector can comprise multiple points of contact (such as four contacts to each receptacle).

In certain exemplary embodiments, shielding on the slide connector might be utilized for a relatively high-frequency grounding between PCBs. The electrically conductive liner of the slide connector can be at a ground potential via contact with the electrically conductive shield of the receptacle.

FIG. 1 is a block diagram of an exemplary embodiment of a system 1000, which can comprise a PLC 1100. PLC 1100 can comprise a circuit 1120. Circuit 1120 can be adapted to automatically perform a method or activity described herein. For example, circuit 1120 can be adapted to communicatively couple PLC 1100 to a first chain of modules 1040, which can comprise a first module 1200, a second module 1300, and a third module 1400. First module 1200, second module 1300, and third module 1400 can be communicatively coupled in a series arrangement. Each adjacent pair of first chain of modules 1040, such as first module 1200 and second module 1300 can be communicatively coupled in series. Each of first module 1200, second module 1300, and third module 1400 can be, and/or can be referred to as, I/O modules and/or I/O expansion modules, which can each be communicatively coupled to a corresponding plurality of sensors, such as a first sensor 1240, a second sensor 1340, and a third sensor 1440. Each of first module 1200, second module 1300, and third module 1400 can be communicatively coupled to a corresponding plurality of actuators such as a first actuator 1280, a second actuator 1380, and a third actuator 1480. Each of first module 1200, second module 1300, and/or third module 1400 can be adapted to communicate with PLC 1100 in hard real-time.

PLC 1100 can be communicatively coupled to a second chain of modules 1080, which can comprise a fourth module 1500, a fifth module 1600, and a sixth module 1700, which can be communicatively coupled in a series arrangement. Each adjacent pair of second chain of modules 1080, such as fourth module 1500 and fifth module 1600 can be communicatively coupled in series. Fourth module 1500, fifth module 1600, and sixth module 1700 can be, and/or can be referred to as, communications modules and/or annex modules, each of which can be communicatively coupled to a plurality of information devices, such as an information device 1540 (illustrated as being communicatively coupled to fourth module 1500).

Figure 2:
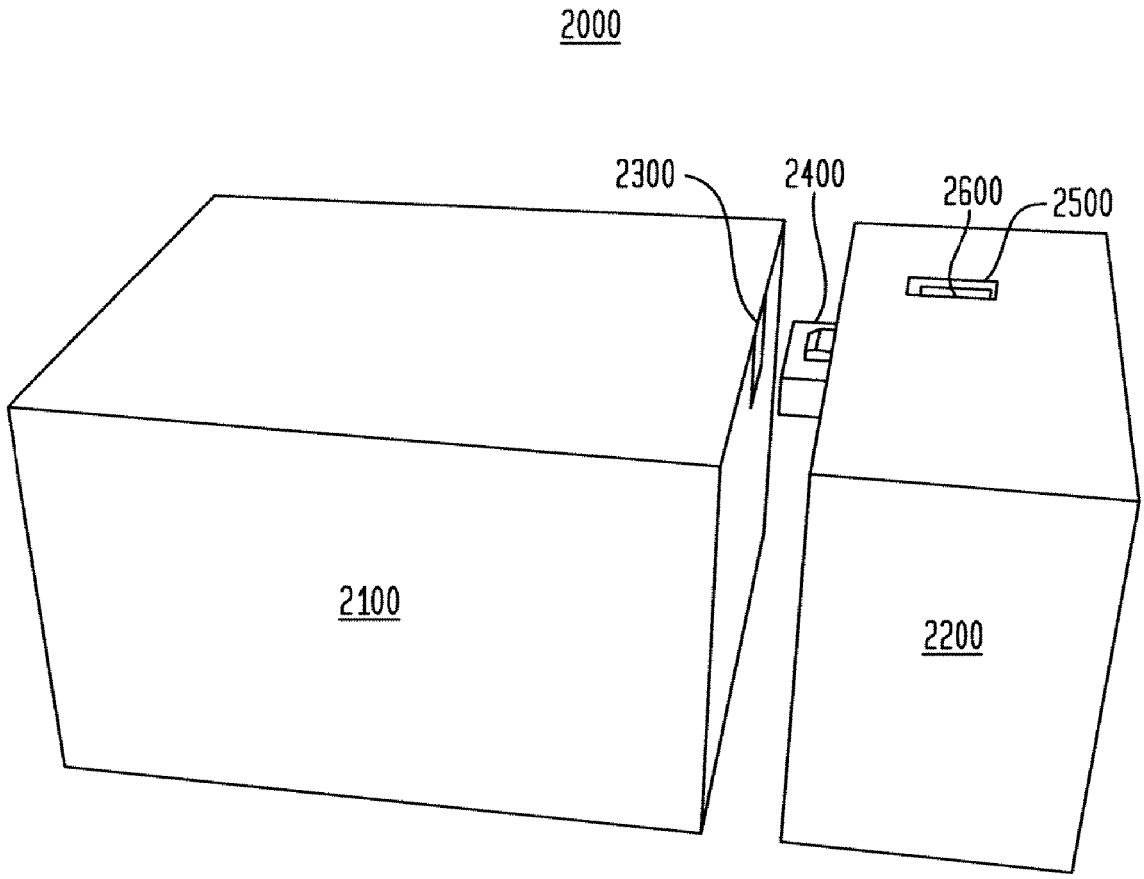
FIG. 2 is a block diagram of an exemplary embodiment of a system 2000.

FIG. 2 is a block diagram of an exemplary embodiment of a system 2000, which can comprise a PLC 2100 and a module 2200. Each of PLC 2100 and module 2200 can each comprise a circuit board. A slide connector 2400 can be electrically coupled to a circuit board comprised by module 2200. Slide connector 2400 can be adapted to electrically couple a circuit board comprised by PLC 2100 to the circuit board of module 2200 via a port 2300 defined by PLC 2100. Slide connector 2400 can be decoupled from the circuit board of PLC 2100 via a depression of a handle 2600, which can be accessible via a port 2500 defined by module 2200.

Figure 3:
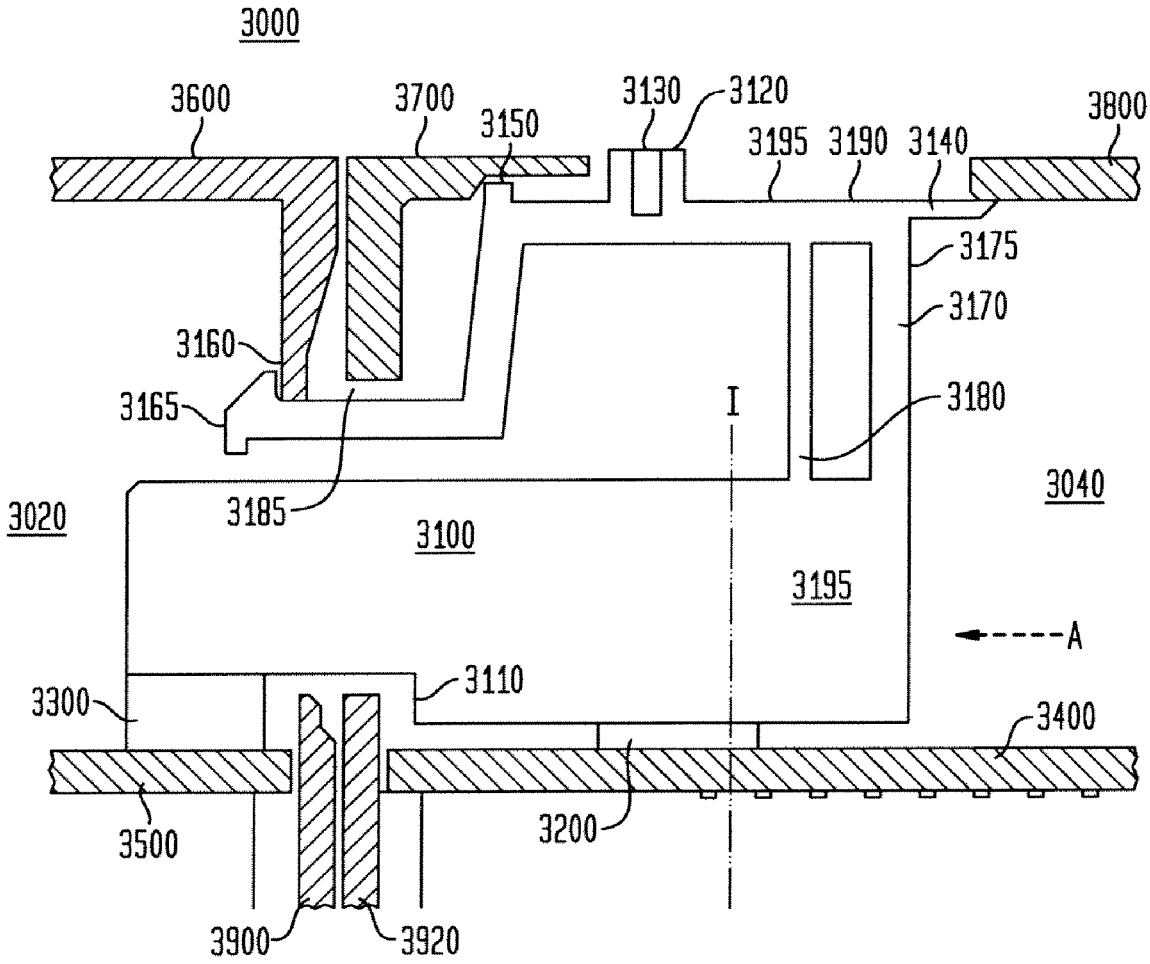
FIG. 3 is a cross-sectional diagram of an exemplary embodiment of a system 3000.

FIG. 3 is a cross-sectional diagram of an exemplary embodiment of a system 3000, which can comprise a PLC 3020 and a module 3040. A second circuit board 3500 of PLC 3020 can be electrically coupled to a first circuit board 3400 of module 3040 via a slide connector 3100. Slide connector 3100 can be releasably coupled to a first receptacle 3200 that is comprised by, attached to, and/or electrically coupled to first circuit board 3400. Slide connector 3100 can be releasably coupled to a second receptacle 3300 that is comprised by, attached to, and/or electrically coupled to second circuit board 3500.

Slide connector 3100 can comprise a stop surface 3110, which can be adapted to interact with an edge of a housing 3900 of PLC 3020 and/or an edge of a housing 3920 of module 3040. Stop surface 3110 can be adapted to restrain motion of slide connector 3100 relative to first circuit board 3400 and/or second circuit board 3500 in a direction of sliding A. Slide connector 3100 can be adapted to be moved in direction of sliding A to operatively couple slide connector 3100 to second receptacle 3300.

Slide connector 3100 can comprise a handle 3190, which can be adapted for use in electrically coupling and decoupling PLC 3020 and module 3040. Handle 3190 can be adapted to receive a motive force to engage slide connector 3100 with at least one of first receptacle 3200 and/or second receptacle 3300. Handle 3190 can be connected to a body 3195 of slide connector 3100 via a first rib 3170 and a second rib 3180. First rib 3170 and second rib 3180 can provide a sufficient rigidity for a locking edge 3160 of handle 3190 to remain secured to a receiving housing 3600 of PLC 3020 when handle 3190 is not being subjected to an external force, the external force having a component that is substantially perpendicular to a plane defined by handle 3190. Handle 3190 can comprise a release button 3120 and/or a slot 3130. Release button 3120 can be disposed on a release button surface 3195 of handle 3190. Via release button 3120 and/or slot 3130 the external force can be manually and/or automatically applied to handle 3190, such as via a screwdriver. The external force can comprise the component that is substantially perpendicular to the plane defined by handle 3190 and can be adapted to depress handle 3190 such that locking edge 3160 disengages from receiving housing 3600 of PLC 3020. Handle 3190 can comprise two mutually substantially perpendicular surfaces 3165 and 3175 at opposing ends of release button surface 3195. Locking edge 3160 can disposed on an end of a surface 3185 that is substantially parallel to release button surface 3195.

Slide connector 3100 can comprise a restraining protrusion 3150, which can be adapted to, in certain operative embodiments, interact with a housing edge 3700 of module 3040 to limit mobility in a direction substantially perpendicular to a plane defined by handle 3190 relative to housing edge 3700 of module 3040. Slide connector 3100 can comprise a restraining lip 3140 that can be adapted to limit mobility in a direction substantially perpendicular to a plane defined by handle 3190 relative to housing body 3800 of module 3040.

Slide connector 3100 can be adapted to electrically couple first circuit board 3400 to second circuit board 3500. Slide connector 3100 can be adapted to be slideably releaseably coupled to each of first receptacle 3200 and second receptacle 3300. Slide connector 3100 can comprise an electrically conductive liner, which can be supported by, and/or biasedly coupled to, an electrically insulating substrate. The electrically conductive liner can be adapted to be electrically coupled to an electrically conductive shield of at least one of first receptacle 3200 and second receptacle 3300. When slide connector 3100 is engaged to first receptacle 3200 but disengaged from second receptacle 3300, second circuit board 3500 can be removable from a mount without moving first circuit board 3400.

When coupled to first receptacle 3200, slide connector 3100 can be adapted to shield first receptacle 3200 from electromagnetic interference on at least three sides of a substantially rectangular cross section I of a junction of slide connector 3100 and first receptacle 3200. First circuit board 3400 can be adapted to shield a connection of first receptacle 3200 and slide connector 3100 from electromagnetic interference on at least one side of substantially rectangular cross section I of the junction of slide connector 3100 and first receptacle 3200 and/or a cross section of a junction of slide connector 3100 and second receptacle 3300.

Figure 4:
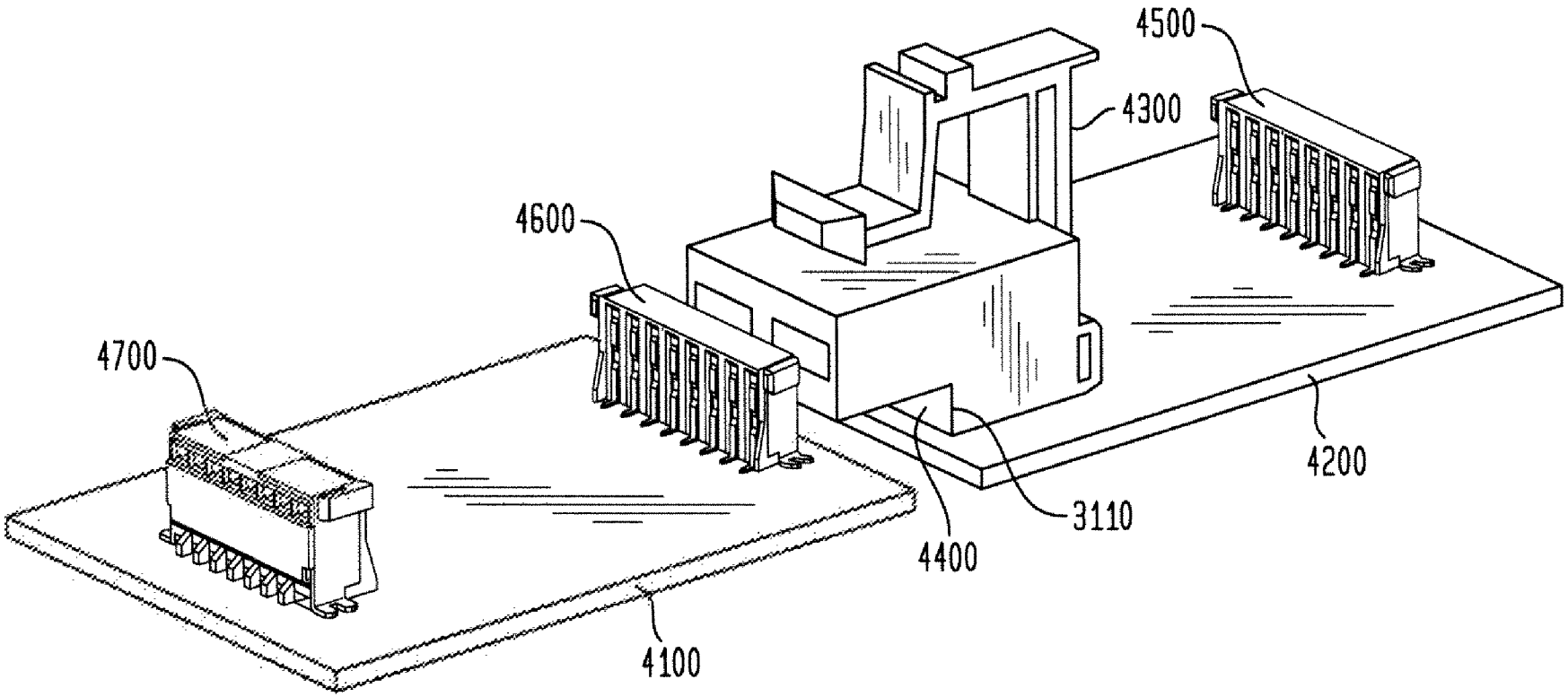
FIG. 4 is a perspective view of an exemplary embodiment of a system 4000.

FIG. 4 is a perspective view of an exemplary embodiment of a system 4000, which can comprise a first circuit board 4100 and a second circuit board 4200. First circuit board 4100 can comprise and/or can be electrically coupled to a first receptacle 4700 and a second receptacle 4600. Second circuit board 4200 can comprise and/or can be electrically coupled to a first receptacle 4400 and a second receptacle 4500. A slide connector 4300 can be electrically coupled to first receptacle 4400 of second circuit board 4200. Via a sliding motion, slide connector 4300 can be electrically coupled to second receptacle 4600 of first circuit board 4100.

Figure 5:
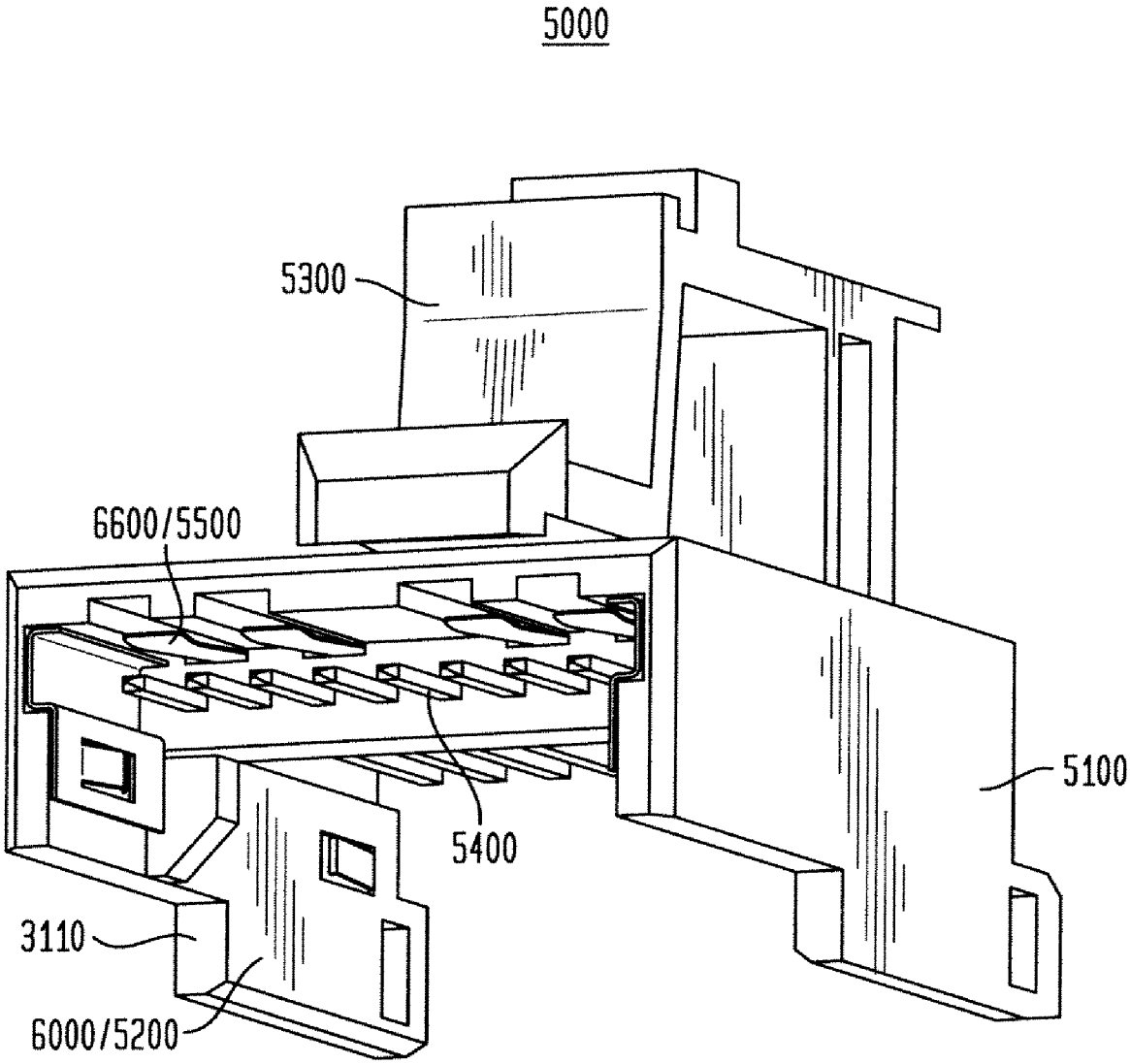
FIG. 5 is a perspective view of an exemplary embodiment of a slide connector 5000.

FIG. 5 is a perspective view of an exemplary embodiment of a slide connector 5000, which can comprise an electrically insulating substrate 5100. Insulating substrate 5100 can comprise a handle 5300. Slide connector 5000 can comprise and/or be attached to an electrically conductive liner 5200, which can be supported by, and/or biasedly coupled to, electrically insulating substrate 5100. Slide connector 5000 can comprise a plurality of metallic extensions 5400, which can be adapted to be electrically coupled to a corresponding plurality of signal ports of a corresponding receptacle. Slide connector 5000 can comprise one or more portions that can be electrically coupled to a corresponding electrically conductive shield of a receptacle. For example, electrically conductive tabs 5500 can be adapted to be biasedly electrically coupled to a cap of the corresponding electrically conductive shield of a receptacle.

Figure 6:
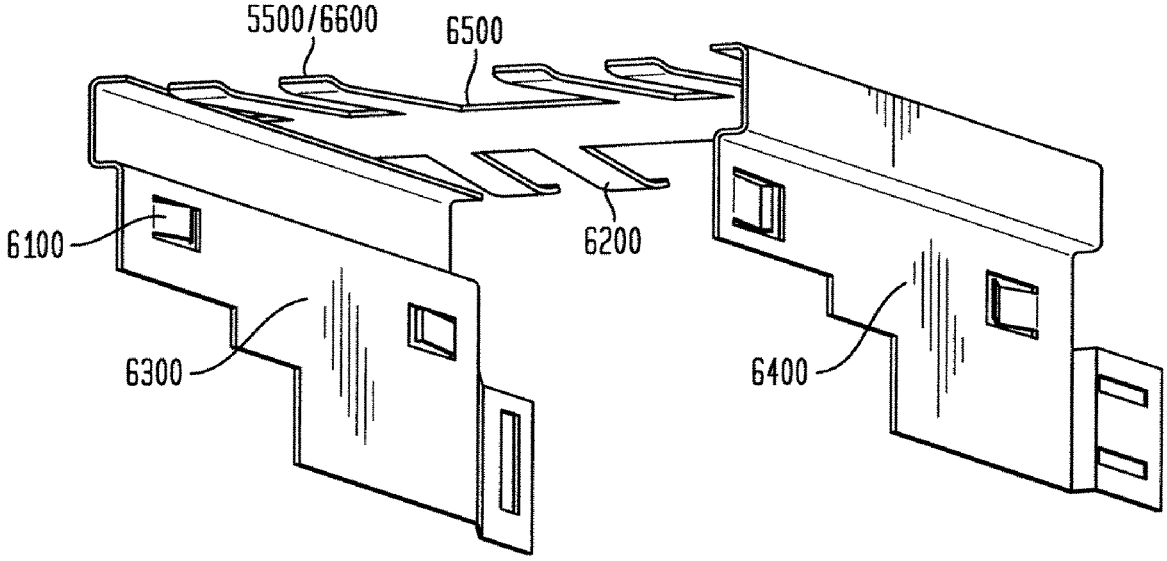
FIG. 6 is a perspective view of an exemplary embodiment of an electrically conductive liner of a slide connector 6000.

FIG. 6 is a perspective view of an exemplary embodiment of an electrically conductive liner 6000 of a slide connector, which can comprise one or more spring locks 6100. Spring locks 6100 can be adapted to springably and/or biasedly couple electrically conductive liner 6000 to the slide connector. Electrically conductive liner 6000 can comprise a plurality of spring couplers 6200 that can be adapted to electrically couple electrically conductive liner 6000 to an electrically conductive shield of a receptacle. Electrically conductive liner 6000 can comprise a first wall 6300, a second wall 6400, and a cap 6500. A plane defined by cap 6500 can be substantially perpendicular to planes defined by each of first wall 6300 and second wall 6400.

Figure 7:
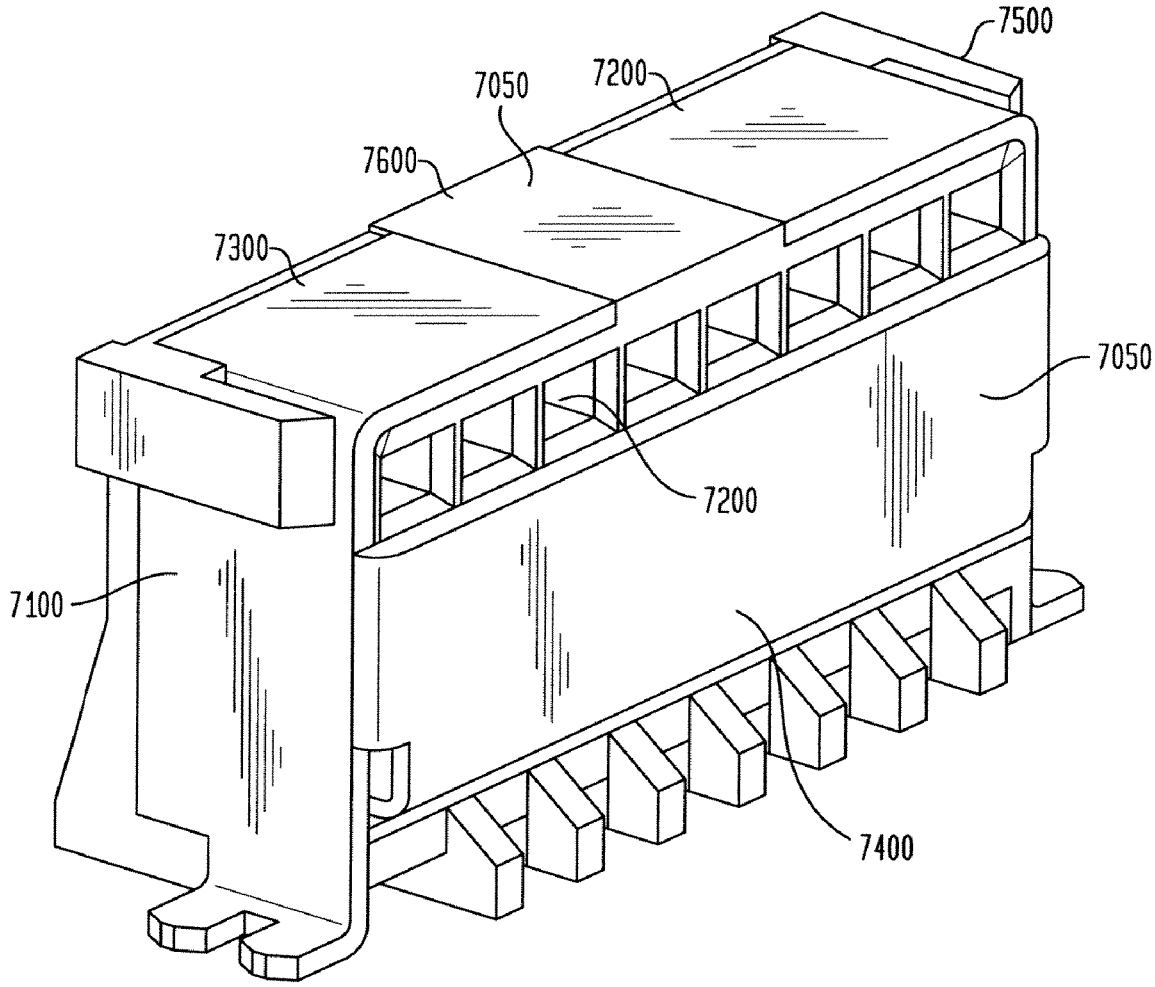
FIG. 7 is a perspective view of an exemplary embodiment of a receptacle 7000.

FIG. 7 is a perspective view of an exemplary embodiment of a receptacle 7000, which can comprise an electrically conductive shield 7050. Electrically conductive shield 7050 can be electrically coupled to a ground connection. Receptacle 7000 can define a plurality of signal ports 7200 which can be adapted to be electrically coupled to a plurality of metallic extensions of a slide connector (such as metallic extensions 5400 of FIG. 5) via insertion of the metallic extensions into signal ports 7200. Electrically conductive shield 7050 can comprise a first shield wall 7100 and an opposing second shield wall 7500. First shield wall 7100 and second shield wall 7500 can be connected by a shield cap 7300 and a shield face 7400. A first plane defined by shield cap 7300 can be substantially perpendicular to a second plane defined by shield face 7400. The plane defined by shield cap 7300 can be substantially perpendicular to a third plane defined by first shield wall 7100 and a fourth plane defined by second shield wall 7500. In certain exemplary embodiments, as illustrated, cap 7300 can be separated into two or more portions via a divider 7600. A corresponding portion of an electrically conductive liner of a slide connector (e.g., electrically conductive tabs 5500 of FIG. 5) can be electrically coupled to cap 7300.

Each of first wall 6300, second wall 6400, and cap 6500 of FIG. 6 can be electrically coupled to, and form an EMI shield in conjunction with, corresponding portions of an electrically conductive shield of a corresponding receptacle. For example, in certain operative embodiments, first wall 6300 can be substantially parallel to and electrically coupled to second shield wall 7500 (of FIG. 7), second wall 6400 can be substantially parallel to and electrically coupled to first shield wall 7100, and cap 6500 can be substantially parallel to and electrically coupled to shield cap 7300 (cap 6500 can be electrically coupled to shield cap 7300 via tabs 6600).

Figure 8:
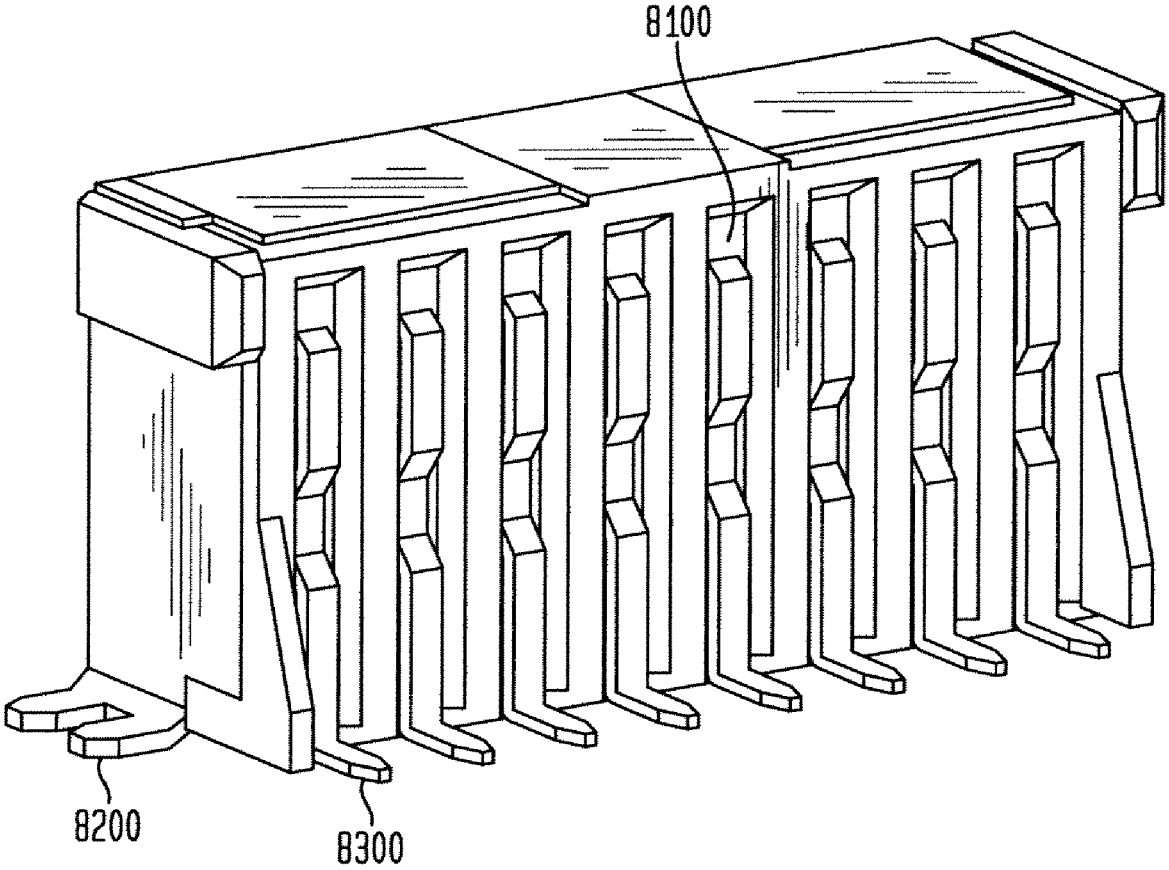
FIG. 8 is a perspective view of an exemplary embodiment of a receptacle 8000.

FIG. 8 is a perspective view of an exemplary embodiment of a receptacle 8000, which can define a plurality of signal ports 8100 which can be adapted to be electrically coupled to a plurality of metallic extensions of a slide connector (not illustrated). Receptacle 8000 can comprise one or more electrically conductive shield terminals 8200, which can be adapted to be electrically coupled to an electrical ground connection of a circuit board. Receptacle 8000 can comprise a plurality of connectors 8300, which can be surface mount connectors or through-hole connectors. Plurality of connectors 8300 can be adapted to electrically couple electrical connectors associated with signal ports 8100 to corresponding circuits of the circuit board adapted to be electrically coupled to receptacle 8000. Receptacle 8000 can be a first receptacle or a second receptacle. One or more electrically conductive shield terminals 8200 and/or plurality of connectors 8300 can be attached to the circuit board via a soldered connection.

Figure 9:
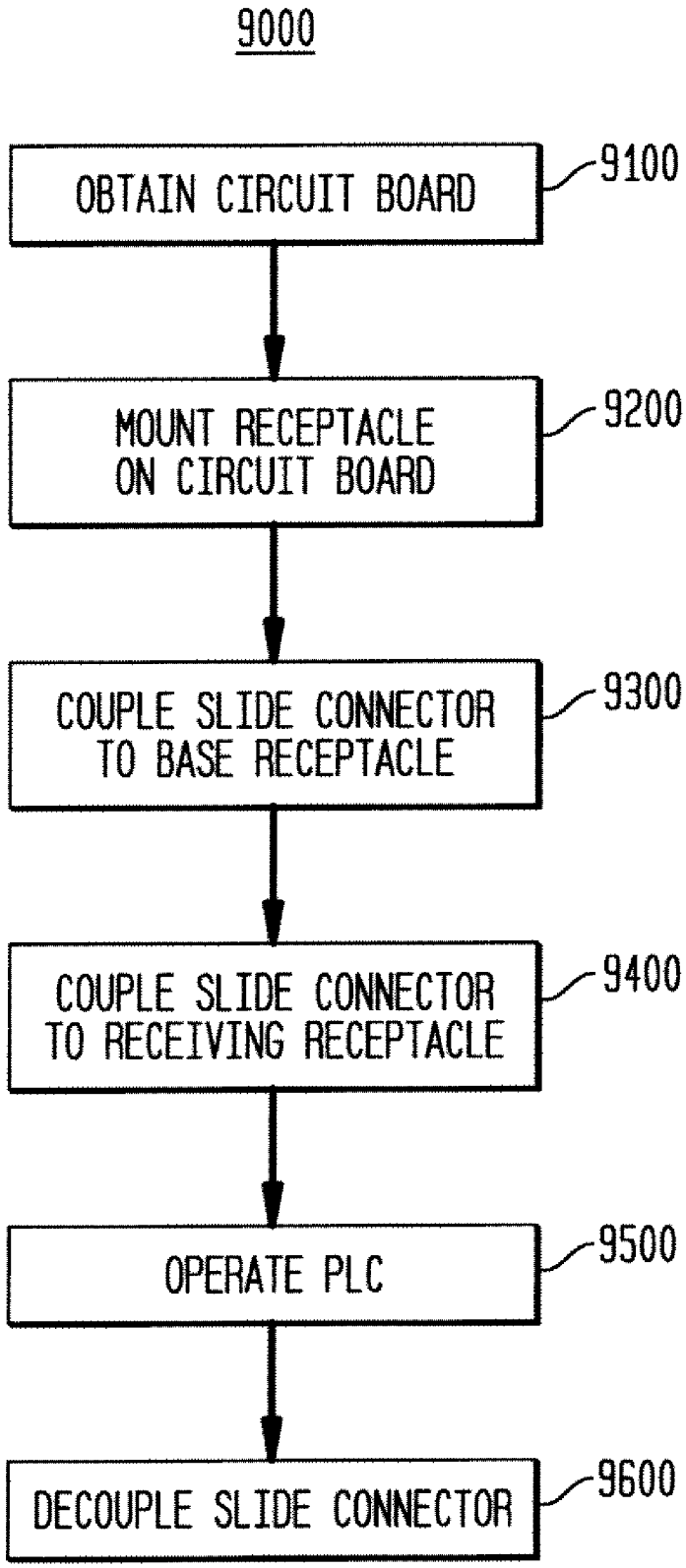
FIG. 9 is a flowchart of an exemplary embodiment of a method 9000.

FIG. 9 is a flowchart of an exemplary embodiment of a method 9000. At activity 9100, a circuit board can be obtained. The circuit board can be adapted to comprise a first receptacle and/or a second receptacle.

At activity 9200, a receptacle can be mounted on the circuit board. The receptacle can be a first receptacle and/or a second receptacle. The first receptacle and/or the second receptacle can be adapted to be slideably releaseably coupled via a slide connector.

At activity 9300, the slide connector can be electrically and/or communicatively coupled to the first receptacle and thereby electrically couple the slide connector to a first circuit board that is electrically coupled to the first receptacle. The slide can be adapted to electrically couple the first circuit board to a second circuit board that comprises a second receptacle.

At activity 9400, the slide connector can be electrically and/or communicatively coupled to the second receptacle comprised by and/or electrically coupled to the second circuit board. The slide connector can be adapted to be slideably releaseably coupled to each of the first receptacle of the first circuit board and the second receptacle of the second circuit board. The slide connector can comprise an electrically conductive liner supported by, and biasedly coupled to, an electrically insulating substrate. The electrically conductive liner can be adapted to be electrically coupled to an electrically conductive shield of at least one of the first receptacle of the first circuit board and the second receptacle of the second circuit board. When coupled to the second receptacle, the slide connector can be adapted to shield the metallic extensions contained in the slider (5400 of FIG. 5) from electromagnetic interference on at least three sides of a substantially rectangular cross section of a junction of the slide connector, the first receptacle of the first circuit board, and/or the second receptacle of the second circuit board. The slide connector can comprise a stop surface, which can be adapted to restrain motion of the slide connector, via an interaction with a PLC housing and/or a module housing, relative to the first circuit board and/or the second circuit board in a direction of sliding of the slide connector. The slide connector can be adapted to be moved in the direction of sliding to operatively couple the slide connector to the first receptacle of the first circuit board.

At activity 9500, the PLC system can be operated. The PLC system can comprise a PLC, which can comprise the second circuit board and/or a module that comprises the second circuit board.

At activity 9600, the slide connector can be decoupled from the second receptacle. The second circuit board and/or a housing comprising the second circuit board can be relocated once the slide connector is decoupled from the second receptacle.

Figure 10:
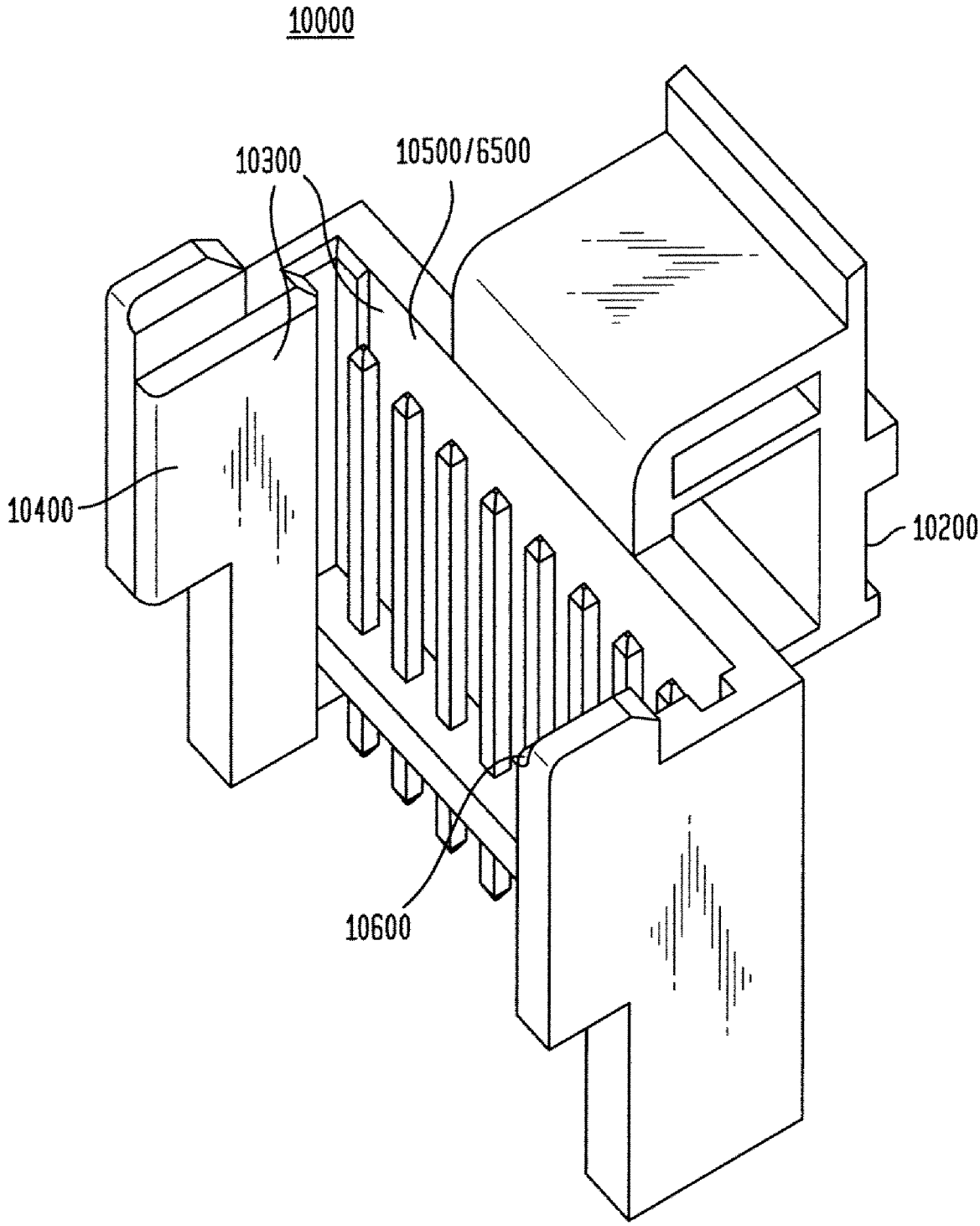
FIG. 10 is a perspective view of an exemplary embodiment of a slide connector 10000.

FIG. 10 is a perspective view of an exemplary embodiment of a slide connector 10000, which can comprise a handle 10200 and an electrically conductive liner 10300. Electrically conductive liner 10300 can comprise a first wall 10400 and an opposing second wall 10600. The first wall 10400 and the second wall 10600 can be connected by a liner cap 10500. A first plane defined by liner cap 10500 can be substantially perpendicular to a second plane defined by first wall 10400.

Figure 11:
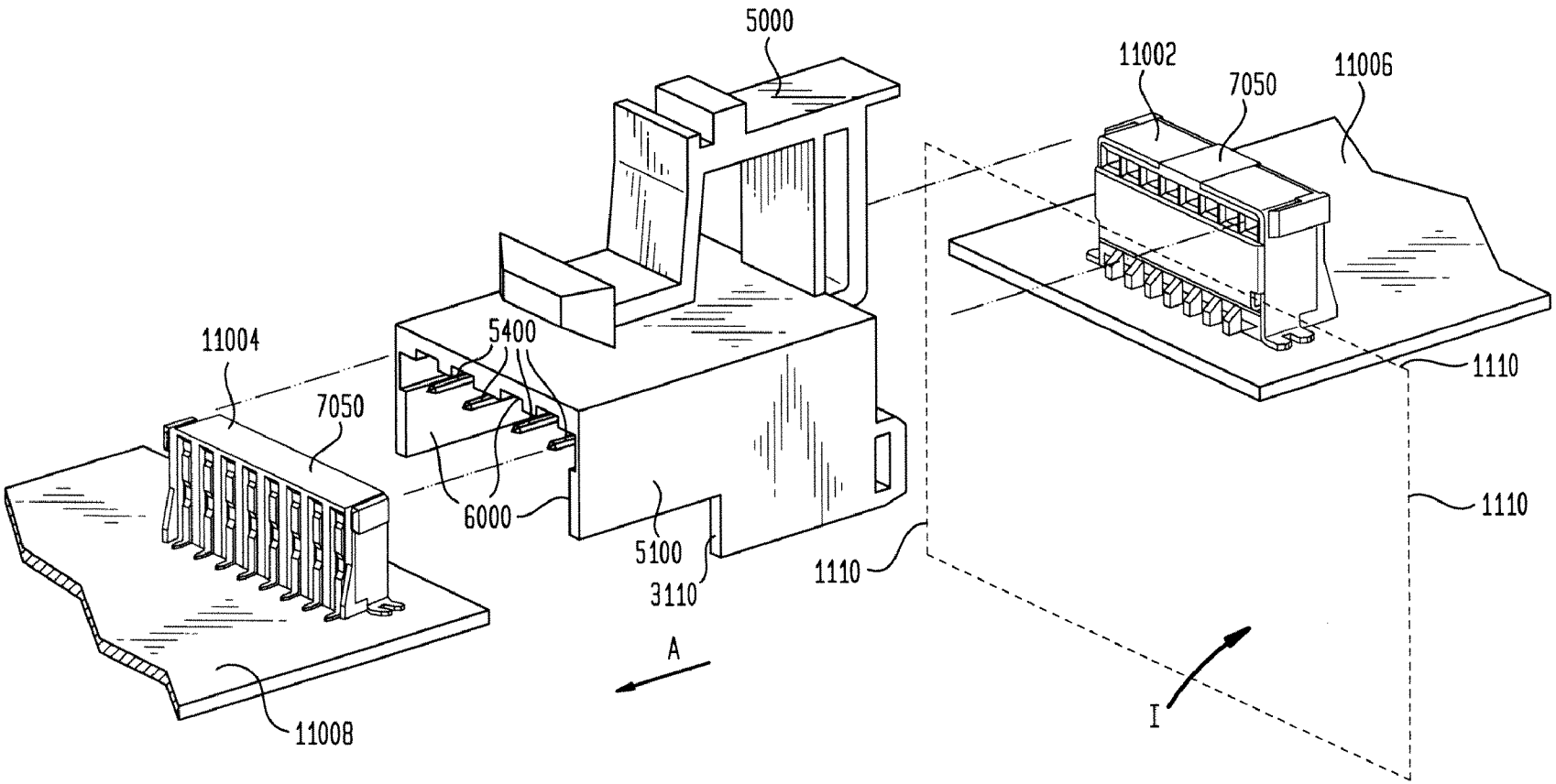
FIG. 11 is an exploded isometric view of an exemplary embodiment of slide connector 5000 engaging a first receptacle 11002 and a second receptacle 11004.

FIG. 11 is an exploded isometric view of engaging a slide connector 5000 with a first receptacle 11002, said slide connector 5000 adapted to electrically couple a first circuit board 11006 to a second circuit board 11008, said first circuit board 11006 comprising said first receptacle 11002, said second circuit board 11008 comprising a second receptacle 11004, said slide connector 5000 adapted to be slideably releaseably coupled to each of said first receptacle 11002 and said second receptacle 11004, said slide connector 5000 comprising an electrically conductive liner 6000 supported by, and biasedly coupled to, an electrically insulating substrate 5100, said electrically conductive liner 6000 adapted to be electrically coupled to an electrically conductive shield 7050 of at least one of said first receptacle 11002 and said second receptacle 11004 via electrically conductive tabs 5500 (shown in FIG. 5) and/or 6600 (shown in FIG. 6), when coupled to said first receptacle 11002 and said second receptacle 11004, said electrically conductive liner 6000 adapted to shield metallic extensions 5400 of said slide connector 5000 from electromagnetic interference on at least three sides 11010 of a substantially rectangular cross section I of a junction of said slide connector 5000 and said first receptacle 11002, said slide connector 5000 comprising a stop surface 3110, said stop surface 3110 adapted to restrain motion of said slide connector 5000 relative to said first circuit board 11006 or said second circuit board 11008 in a direction of sliding A, said slide connector 5000 adapted to be moved in said direction of sliding A to operatively couple said slide connector 5000 to said second receptacle 11004.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, deed, function, step, and/or process and/or a portion thereof.

actuator—a device that converts, translates, and/or interprets signals (e.g., electrical, optical, hydraulic, pneumatic, etc.) to cause a physical and/or humanly perceptible action and/or output, such as a motion (e.g., rotation of a motor shaft, vibration, position of a valve, position of a solenoid, position of a switch, and/or position of a relay, etc.), audible sound (e.g., horn, bell, and/or alarm, etc.), and/or visible rendering (e.g., indicator light, non-numerical display, and/or numerical display, etc).

adapted to—suitable, fit, and/or capable of performing a specified function.

adapter—a device used to effect operative compatibility between different parts of one or more pieces of an apparatus or system.

adjacent—in close proximity to, near, next to, and/or adjoining.

and/or—either in conjunction with or in alternative to.

apparatus—an appliance or device for a particular purpose.

approximately—about and/or nearly the same as.

associate—to relate, bring together in a relationship, map, combine, join, and/or connect.

associated with—related to.

at least—not less than.

attach—to fasten, secure, couple, and/or join.

first receptacle—a socket assembly adapted to electrically and/or communicatively couple a circuit board to at least one other electronic component, the socket attached directly to a circuit board, the first receptacle can be surface mounted and/or through-hole mounted.

below—beneath; in a lower place; and/or less than.

bias—to urge in a direction.

but—yet.

button—a protuberant part.

can—is capable of, in at least some embodiments.

cap—an at least partially planar portion of an object that is adapted to connect at least a pair of opposing walls of that object, a plane defined by the cap substantially perpendicular to the pair of opposing walls.

capable—a potential for use.

cause—to bring about, provoke, precipitate, produce, elicit, be the reason for, result in, and/or effect.

change—(v) to cause to be different; (n) the act, process, and/or result of altering or modifying.

circuit—an electrically conductive pathway comprising one or more operative electrical devices.

circuit board—a insulating substrate material adapted to receive one or more electronic components that are interconnected to form a circuit and/or group of circuits that perform a specific function.

clip—(n) a weight bearing and/or motion restraining structural component adapted to hold a first object together with respect to a second object. (v) to fasten with a clip.

communicatively couple—to link in a manner that facilitates communications.

comprised by—included by.

comprise—to include but not be limited to.

conduct—to act as a medium for conveying electricity.

configure—to design, arrange, set up, shape, and/or make suitable and/or fit for a specific purpose.

connect—to physically join, link, couple, and/or fasten two or more entities.

connection—a physical link between two or more elements of a system.

convert—to transform, adapt, and/or change, such as from a first form to a second form.

corresponding—related, associated, accompanying, similar in purpose and/or position, conforming in every respect, and/or equivalent and/or agreeing in amount, quantity, magnitude, quality, and/or degree.

couple—to join, connect, and/or link two things together.

coupleable—capable of being joined, connected, and/or linked together.

cross-section—a section formed by a plane cutting through an object at a right angle to an axis.

data—information represented in a form suitable for processing by an information device.

deadline—a time interval during which an activity's completion has more utility to a system, and after which the activity's completion has less utility. Such a time interval might be constrained only by an upper-bound, or it might be constrained by both upper and lower bounds.

define—to establish the meaning, relationship, outline, form, and/or structure of; and/or to precisely and/or distinctly describe and/or specify.

depress—to put into a lower position.

determine—to obtain, calculate, decide, deduce, establish, and/or ascertain.

device—a machine, manufacture, and/or collection thereof.

direction—a spatial relation between something and a course along which it points and/or moves; a distance independent relationship between two points in space that specifies the position of either with respect to the other; and/or a relationship by which the alignment and/or orientation of any position with respect to any other position is established.

disengage—to undo a state of being meshed, mated, connected, interlocked, and/or contacted.

disposed—placed, arranged, and/or oriented.

each—every one of a group considered individually.

edge lock—an appurtenance adapted to engage a border of an object at which a surface of that object terminates.

electrical—relating to producing, distributing, and/or operating by electricity.

electrically conductive—having the quality or power of substantially conducting electricity.

electrically conductive liner—a component comprising one or more electrically conductive surfaces, the component adapted to be coupled to an insulating substrate, the component adapted to partially surround a receptacle, and the component adapted to be electrically coupled to an electrically conductive shield.

electrically conductive shield—a set of one or more electrically conductive surfaces comprised by a receptacle, the set of electrically conductive surfaces adapted to partially surround the receptacle, and the set of electrically conductive surfaces adapted to be electrically coupled to an electrically conductive liner of a slide connector.

electrically coupled—connected in a manner adapted to allow a flow of electricity therebetween.

electrically insulating—having the quality or power of substantially resisting the conduction of electricity.

electromagnetic—energy having a frequency within the electromagnetic spectrum and propagated as a periodic disturbance of the electromagnetic field when an electric charge oscillates or accelerates and/or one of the waves that are propagated by simultaneous periodic variations of electric and magnetic field intensity and that include radio waves, infrared, visible light, ultraviolet, X rays, and gamma rays.

end—an extremity and its vicinity of something that has length; a terminus.

engage—to mesh, mate, connect, and/or interlock and/or to contact, cause to contact, interact, and/or cause to interact.

extension—an addition, portion, and/or element that increases the area, influence, operation, and/or contents of something.

face—an at least partially planar portion of an object that is adapted to connect at least a pair of opposing walls of that object, a plane defined by the face substantially perpendicular to a plane defined by a cap of the object, a plane defined by the face substantially perpendicular to the pair of opposing walls.

first—an initial element of a series.

for—with a purpose of.

from—used to indicate a source.

further—in addition.

ground—a connection between an electrical device and a large conducting body, such as the earth.

handle—a part and/or element adapted to be held, seized, grasped, and/or receive an applied force.

hard deadline—the special case where completing an activity within the deadline results in the system receiving all the utility possible from that activity, and completing the activity outside of the deadline results in zero utility (i.e., resources consumed by the activity were wasted, such as when one travels to the beach to photograph a sunrise on a particular day and arrives after the sun has already arisen) or some negative value of utility (i.e., the activity was counter-productive, such as when firefighters enter a burning building to search for a missing person seconds before the building collapses, resulting in injury or death to the firefighters). The scheduling criterion for a hard deadline is to always meet the hard deadline, even if it means changing the activity to do so.

hard real-time—relating to computer systems that provide an absolute deterministic response to an event. Such a response is not based on average event time. Instead, in such computer systems, the deadlines are fixed and the system must guarantee a response within a fixed and well-defined time. Systems operating in hard real-time typically interact at a low level with physical hardware via embedded systems, and can suffer a critical failure if time constraints are violated. A classic example of a hard real-time computing system is the anti-lock brakes on a car. The hard real-time constraint, or deadline, in this system is the time in which the brakes must be released to prevent the wheel from locking. Another example is a car engine control system, in which a delayed control signal might cause engine failure or damage. Other examples of hard real-time embedded systems include medical systems such as heart pacemakers and industrial process controllers.

have—to be identified by.

housing—something that covers, encloses, protects, holds, and/or supports, such as a frame, box, and/or chassis.

information—facts, terms, concepts, phrases, expressions, commands, numbers, characters, and/or symbols, etc., that are related to a subject. Sometimes used synonymously with data, and sometimes used to describe organized, transformed, and/or processed data. It is generally possible to automate certain activities involving the management, organization, storage, transformation, communication, and/or presentation of information.

information device—any device on which resides a finite state machine capable of implementing at least a portion of a method, structure, and/or or graphical user interface described herein. An information device can comprise well-known communicatively coupled components, such as one or more network interfaces, one or more processors, one or more memories containing instructions, one or more input/output (I/O) devices, and/or one or more user interfaces (e.g., coupled to an I/O device) via which information can be rendered to implement one or more functions described herein. For example, an information device can be any general purpose and/or special purpose computer, such as a personal computer, video game system (e.g., PlayStation, Nintendo Gameboy, X-Box, etc.), workstation, server, minicomputer, mainframe, supercomputer, computer terminal, laptop, wearable computer, and/or Personal Digital Assistant (PDA), iPod, mobile terminal, Bluetooth device, communicator, "smart" phone (such as a Treo-like device), messaging service (e.g., Blackberry) receiver, pager, facsimile, cellular telephone, a traditional telephone, telephonic device, a programmed microprocessor or microcontroller and/or peripheral integrated circuit elements, a digital signal processor, an ASIC or other integrated circuit, a hardware electronic logic circuit such as a discrete element circuit, and/or a programmable logic device such as a PLD, PLA, FPGA, or PAL, or the like, etc.

input—a signal, data, and/or information provided to a processor, device, and/or system.

install—to connect and/or place in position and prepare for use.

interface—(n) a boundary across which two independent systems meet and act on and/or communicate with each other. (v) to connect with and/or interact with by way of an interface.

interference—something that obstructs or impedes.

junction—a location where two or more things come together.

lock—(n) a device and/or system adapted to fix in place, hold, entangle, and/or interlock securely. (v) to fix in place, hold, entangle, and/or interlock securely.

may—is allowed and/or permitted to, in at least some embodiments.

memory—a device capable of storing analog or digital information, for example, a non-volatile memory, volatile memory, Random Access Memory, RAM, Read Only Memory, ROM, flash memory, magnetic media, a hard disk, a floppy disk, a magnetic tape, an optical media, an optical disk, a compact disk, a CD, a digital versatile disk, a DVD, and/or a raid array, etc. The memory can be coupled to a processor and can store instructions adapted to be executed by processor according to an embodiment disclosed herein.

method—a process, procedure, and/or collection of related activities for accomplishing something.

more—additional.

moving—to transfer from one location to another.

metallic—comprising a metal.

method—a process, procedure, and/or collection of related activities for accomplishing something.

mount—(n) that upon which a thing is attached. (v) to couple, fix, and/or attach on and/or to something.

motion—changing position or place.

motive force—a capacity to do work or cause physical change that causes a change in position or place of an object and/or system.

move—to change a position and/or place.

mutually—of or pertaining to each of two or more.

network—a communicatively coupled plurality of nodes. A network can be and/or utilize any of a wide variety of sub-networks, such as a circuit switched, public-switched, packet switched, data, telephone, telecommunications, video distribution, cable, terrestrial, broadcast, satellite, broadband, corporate, global, national, regional, wide area, backbone, packet-switched TCP/IP, Fast Ethernet, Token Ring, public Internet, private, ATM, multi-domain, and/or multi-zone sub-network, one or more Internet service providers, and/or one or more information devices, such as a switch, router, and/or gateway not directly connected to a local area network, etc.

occur—to take place.

one—a single unit.

operative—being in effect; operating.

opposing—opposite; against; being the other of two complementary or mutually exclusive things; placed or located opposite, in contrast, in counterbalance, and/or across from something else and/or from each other.

parallel—of, relating to, or designating lines, curves, planes, and/or or surfaces everywhere equidistant and/or an arrangement of components in an electrical circuit that splits an electrical current into two or more paths.

perpendicular—intersecting at or forming substantially right angles.

planar—shaped as a substantially flat two-dimensional surface.

plane—a substantially flat surface.

plurality—the state of being plural and/or more than one.

port—an opening adapted for insertion and/or passage of a part.

predetermined—established in advance.

processor—a device and/or set of machine-readable instructions for performing one or more predetermined tasks. A processor can comprise any one or a combination of hardware, firmware, and/or software. A processor can utilize mechanical, pneumatic, hydraulic, electrical, magnetic, optical, informational, chemical, and/or biological principles, signals, and/or inputs to perform the task(s). In certain embodiments, a processor can act upon information by manipulating, analyzing, modifying, converting, transmitting the information for use by an executable procedure and/or an information device, and/or routing the information to an output device. A processor can function as a central processing unit, local controller, remote controller, parallel controller, and/or distributed controller, etc. Unless stated otherwise, the processor can be a general-purpose device, such as a microcontroller and/or a microprocessor, such the Pentium IV series of microprocessor manufactured by the Intel Corporation of Santa Clara, Calif. In certain embodiments, the processor can be dedicated purpose device, such as an Application Specific Integrated Circuit (ASIC) or a Field Programmable Gate Array (FPGA) that has been designed to implement in its hardware and/or firmware at least a part of an embodiment disclosed herein.

programmable logic controller (PLC)—a solid-state, microprocessor-based, hard real-time computing system that is used, via a network, to automatically monitor the status of field-connected sensor inputs, and automatically control communicatively-coupled devices of a controlled industrial system (e.g., actuators, solenoids, relays, switches, motor starters, speed drives (e.g., variable frequency drives, silicon-controlled rectifiers, etc.), pilot lights, ignitors, tape drives, speakers, printers, monitors, displays, etc.) according to a user-created set of values and user-created logic and/or instructions stored in memory. The sensor inputs reflect measurements and/or status information related to the controlled industrial system. A PLC provides any of: automated input/output control; switching; counting; arithmetic operations; complex data manipulation; logic; timing; sequencing; communication; data file manipulation; report generation; control; relay control; motion control; process control; distributed control; and/or monitoring of processes, manufacturing equipment, and/or other automation of the controlled industrial system. Because of its precise and hard real-time timing and sequencing capabilities, a PLC is programmed using ladder logic or some form of structured programming language specified in IEC 61131-3, namely, FBD (Function Block Diagram), LD (Ladder Diagram), SFC (Structured Text, Pascal type language), IL (Instruction List) and/or SFC (Sequential Function Chart). Because of its precise and real-time timing and sequencing capabilities, a PLC can replace up to thousands of relays and cam timers. PLC hardware often has good redundancy and fail-over capabilities. A PLC can use a Human-Machine Interface (HMI) for interacting with users for configuration, alarm reporting, and/or control.

project—to calculate, estimate, or predict.

provide—to furnish, supply, give, convey, send, and/or make available.

real-time—a system (or sub-system) characterized by time constraints on individual activities and scheduling criteria for using those time constraints to achieve acceptable system timeliness with acceptable predictability.

receive—to gather, take, acquire, obtain, accept, get, and/or have bestowed upon.

second receptacle—a socket assembly adapted to electrically and/or communicatively couple a circuit board to at least one other electronic component, the socket attached directly to a circuit board, the first receptacle can be surface mounted and/or through-hole mounted.

relative—considered with reference to and/or in comparison to something else.

release—to let go and/or free from something that restrains, binds, fastens, and/or holds back.

releaseably—capable of being substantially non-destructively freed from something that binds, fastens, or holds back.

releasably attach—to fasten together in a manner that allows for substantially non-destructive unfastening.

removable—capable of being moved from a place or position occupied.

restrain—to limit and/or restrict.

said—when used in a system or device claim, an article indicating a subsequent claim term that has been previously introduced.

second—an element that immediately follows an initial element of a series.

secure—to fasten.

sensor—a device adapted to automatically sense, perceive, detect, and/or measure a physical property (e.g., pressure, temperature, flow, mass, heat, light, sound, humidity, proximity, position, velocity, vibration, loudness, voltage, current, capacitance, resistance, inductance, and/or electro-magnetic radiation, etc.) and convert that physical quantity into a signal. Examples include proximity switches, stain gages, photo sensors, thermocouples, level indicating devices, speed sensors, accelerometers, electrical voltage indicators, electrical current indicators, on/off indicators, and/or flowmeters, etc.

set—a related plurality of predetermined elements; and/or one or more distinct items and/or entities having a specific common property or properties.

shield—(n) a protective device or structure adapted to reduce effects of external electric and magnetic fields. (v) to reduce effects of external electric and magnetic fields.

side—a surface bounding a solid object.

signal—information, such as machine instructions for activities and/or one or more letters, words, characters, symbols, signal flags, visual displays, and/or special sounds, etc. having prearranged meaning, encoded as automatically detectable variations in a physical variable, such as a pneumatic, hydraulic, acoustic, fluidic, mechanical, electrical, magnetic, optical, chemical, and/or biological variable, such as power, energy, pressure, flowrate, viscosity, density, torque, impact, force, voltage, current, resistance, magnetomotive force, magnetic field intensity, magnetic field flux, magnetic flux density, reluctance, permeability, index of refraction, optical wavelength, polarization, reflectance, transmittance, phase shift, concentration, and/or temperature, etc. Depending on the context, a signal and/or the information encoded therein can be synchronous, asynchronous, hard real-time, soft real-time, non-real time, continuously generated, continuously varying, analog, discretely generated, discretely varying, quantized, digital, broadcast, multicast, unicast, transmitted, conveyed, received, continuously measured, discretely measured, processed, encoded, encrypted, multiplexed, modulated, spread, de-spread, demodulated, detected, de-multiplexed, decrypted, and/or decoded, etc.

slide—to, in a smooth and/or continuous motion, move one object relative to another.

slideably—a smooth and/or continuous motion of one object relative to another.

slide connector—a device adapted to electrically and/or communicatively couple a first circuit board to a second circuit board, the device engaged via a smooth and/or continuous motion relative to the first circuit board and/or the second circuit board.

socket—an opening or a cavity into which an inserted part is designed to fit.

soft deadline—the general case where completing the activity by the deadline results in the system receiving a utility measured in terms of lateness (completion time minus deadline), such that there exist positive lateness values corresponding to positive utility values for the system. Lateness can be viewed in terms of tardiness (positive lateness), or earliness (negative lateness). Generally, and potentially within certain bounds, larger positive values of lateness or tardiness represent lower utility, and larger positive values of earliness represent greater utility.

soft real-time—relating to computer systems that take a best efforts approach and minimize latency from event to response as much as possible while keeping throughput up with external events overall. Such systems will not suffer a critical failure if time constraints are violated. For example, live audio-video systems are usually soft real-time; violation of time constraints can result in degraded quality, but the system can continue to operate. Another example is a network server, which is a system for which fast response is desired but for which there is no deadline. If the network server is highly loaded, its response time may slow with no failure in service. This is contrasted with the anti-lock braking system where a slowdown in response would likely cause system failure, possibly even catastrophic failure.

solder—to join via a fusion of a metal alloy without melting or fusing objects being joined.

spring—a flexible elastic object, such as a coil of wire, bent bar, coupled set of plates, washer, etc., that regains its original shape after being compressed or extended, is used to store mechanical energy, and is often made of hardened and tempered material, such as steel. Types of springs can include coil springs, helical springs, conical springs, torsion springs, tension springs, compression springs, leaf springs, V-springs, spiral springs, spring washers, gas springs, rubber bands, etc.

stop—cease or end.

store—to place, hold, retain, enter, and/or copy into and/or onto a machine-readable medium.

substantially—to a considerable, large, and/or great, but not necessarily whole and/or entire, extent and/or degree.

substrate—an underlying layer.

support—to bear the weight of, especially from below.

surface—the outer boundary of an object or a material layer constituting or resembling such a boundary.

system—a collection of mechanisms, devices, data, and/or instructions, the collection designed to perform one or more specific functions.

three—one plus one plus one.

transmit—to provide, furnish, supply, send as a signal, and/or to convey (e.g., force, energy, and/or information) from one place and/or thing to another.

two—one plus one.

utilize—to use and/or put into service.

via—by way of and/or utilizing.

wall—an at least partially planar portion of an object.

wherein—in regard to which; and; and/or in addition to.

when—at a time.

with—accompanied by.

without—not accompanied by.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, abstract, drawing figure, etc.) of this application, unless clearly specified to the contrary, such as via an explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- any elements can be integrated, segregated, and/or duplicated;
- any activity can be repeated, performed by multiple entities, and/or performed in multiple jurisdictions; and
- any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

Accordingly, every portion (e.g., title, field, background, summary, abstract, drawing figure, etc.) of this application, other than the claims themselves, is to be regarded as illustrative in nature, and not as restrictive.

What is claimed is:

1. A method comprising:

engaging a slide connector with a first receptacle, said slide connector adapted to electrically couple a first circuit board to a second circuit board, said first circuit board comprising said first receptacle, said second circuit board comprising a second receptacle, said slide connector adapted to be slideably releaseably coupled to each of said first receptacle and said second receptacle, said slide connector comprising an electrically conductive liner supported by, and biasedly coupled to, an electrically insulating substrate, said electrically conductive liner adapted to be electrically coupled to an electrically conductive shield of at least one of said first receptacle and said second receptacle via electrically conductive tabs, when coupled to said first receptacle and said second receptacle, said electrically conductive liner having at least three surfaces disposed substantially along three inner sides of a substantially rectangular cross section of a junction of said slide connector and said first receptacle and adapted to shield metallic extensions of said slide connector from electromagnetic interference, said slide connector comprising a stop surface, said stop surface adapted to restrain motion of said slide connector relative to said first circuit board or said second circuit board in a direction of sliding, said slide connector adapted to be moved in said direction of sliding to operatively couple said slide connector to said second receptacle.

2. The method of claim 1, further comprising:

moving said slide connector in said direction of sliding to operatively couple said slide connector to said second receptacle.

3. The method of claim 1, further comprising:

restraining motion of said slide connector relative to said first circuit board or said second circuit board in said direction of sliding.

4. The method of claim 1, further comprising:

slideably releaseably coupling said first receptacle with said second receptacle.

5. The method of claim 1, further comprising:

electrically coupling said first circuit board to said second circuit board.

6. The method of claim 1, further comprising:

electrically coupling said electrically conductive liner to said electrically conductive shield of at least one of said first receptacle and said second receptacle.

7. The method of claim 1, further comprising:

electrically shielding said metallic extensions of said slide connector from electromagnetic interference on at least three sides of said substantially rectangular cross section of said junction of said slide connector and said first receptacle.

8. The method of claim 1, further comprising:

slideably releaseably de-coupling said first receptacle from said second receptacle.

9. The method of claim 1, further comprising:

electrically de-coupling said electrically conductive liner from said conductive plane of at least one of first receptacle and said second receptacle.

10. The method of claim 1, wherein said electrically conductive liner comprises a first wall and an opposing second wall, said first wall and said second wall connected by a liner cap, a first plane defined by said liner cap substantially perpendicular to a second plane defined by said first wall.

11. The method of claim 1, wherein said electrically conductive shield comprises a first wall and an opposing second wall, said first wall and said second wall connected by a shield cap and a shield face, a first plane defined by said shield cap substantially perpendicular to a second plane defined by said shield face, said plane defined by said shield cap substantially perpendicular to a third plane defined by said first wall.

12. The method of claim 1, wherein said first receptacle is attached to said first circuit board via a soldered connection.

13. The method of claim 1, wherein said slide connector comprises a locking clip adapted to secure a receiving housing to said slide connector.

14. The method of claim 1, wherein each of said first receptacle and said second receptacle comprise signal ports and one or more electrically conductive shields.

15. The method of claim 1, wherein said electrically conductive shield is conductively coupled to an electrical ground.

16. The method of claim 1, wherein said electrically conductive liner comprises a set of spring locks adapted to releasably attach said electrically conductive liner to said slide connector.

17. The method of claim 1, wherein said slide connector comprises a set of metallic extensions adapted to be electrically coupled to a corresponding plurality of signal ports comprised by at least one of said first receptacle and said second receptacle.

18. The method of claim 1, wherein said slide connector comprises a handle adapted to receive a motive force to engage said slide connector with at least one of said first receptacle and said second receptacle, said insulating substrate comprising said handle, said handle comprising a locking edge adapted to lock said slide connector to a receiving housing, said handle comprising a release button, when depressed, said release button adapted to release said locking edge from said receiving housing, said release button disposed on a release button surface of said handle, said handle comprising two mutually substantially perpendicular surfaces at opposing ends of said release button surface, said locking edge disposed on an end of a surface that is substantially parallel to said release button surface.

19. The method of claim 1, wherein when said slide connector is engaged to said first receptacle but disengaged from said second receptacle, said first circuit board is removable from a mount without moving said second circuit board.

* * * * *